United States Patent [19]

Maruyama

[11] Patent Number: 4,768,986

[45] Date of Patent: Sep. 6, 1988

[54] APPARATUS FOR MOUNTING A SHADOW MASK ON A PANEL IN MANUFACTURING COLOR PICTURE TUBES

[75] Inventor: Asao Maruyama, Himeji, Japan

[73] Assignee: Tsubakimoto Chain Co., Osaka, Japan

[21] Appl. No.: 946,494

[22] Filed: Dec. 24, 1986

[30] Foreign Application Priority Data

Dec. 28, 1985 [JP] Japan ..... 60-293517

[51] Int. Cl.[4] ..... H01J 9/00

[52] U.S. Cl. ..... 445/68; 445/30

[58] Field of Search ..... 445/68, 30

[56] References Cited

U.S. PATENT DOCUMENTS

| | | | |
|---|---|---|---|
| 4,138,774 | 2/1979 | Oyama | 445/68 |
| 4,164,060 | 8/1979 | Hartta | 445/38 |
| 4,356,606 | 11/1982 | Dougherty | 445/68 |
| 4,406,638 | 9/1983 | DeAngelis | 445/68 |
| 4,451,242 | 5/1984 | Miyazawa | 445/68 |
| 4,451,243 | 5/1984 | D'Augustine et al. | 445/68 |
| 4,605,879 | 8/1986 | Rath | 445/68 |
| 4,610,636 | 9/1986 | Gaig | 445/68 |
| 4,639,230 | 1/1987 | Meyle | 445/68 |
| 4,648,346 | 3/1987 | Miyazawa | 445/68 |

*Primary Examiner*—Kurt Rowan

*Attorney, Agent, or Firm*—Dann, Dorfman, Herrell & Skillman

[57] ABSTRACT

Apparatus for use in manufacturing color picture tubes to mount a shadow mask within the tube panel to enable repeated removal and replacement. The panel is placed into position overlying the shadow mask so that the inwardly-directed pins on the interior of the panel are in general vertical registry with the apertured spring elements about the outer periphery of the shadow mask. An alignment stand is provided for each spring element to vertically align each spring element with its corresponding panel pin. Each alignment stand includes a dummy pin which may be inserted into the aperture of the spring element of the shadow mask and a rod arm having a guide groove which may be raised so that at its upper limit position the arm provides guide grooves in which the inwardly projecting pins of the panel may be engaged. Clamping elements with upwardly facing V-shaped grooves are provided to engage over the dummy pin and be displaced toward the mask so as to deflect the spring members inwardly to disengage the dummy pins which are then retracted. The mask with the spring elements deflected inwardly is then raised until the V-shaped groove of the clamp members engage the panel pin so that the clamp may be withdrawn allowing the spring members to engage the panel pins to mount the mask in the panel.

11 Claims, 12 Drawing Sheets

APPARATUS FOR MOUNTING A SHADOW MASK ON A PANEL IN MANUFACTURING COLOR PICTURE TUBES

FIELD OF THE INVENTION

The present invention relates to an apparatus for mounting a shadow mask on a panel which is capable of dealing with panel coating for various kinds of cathode ray tubes in an apparatus for manufacturing picture tubes.

DESCRIPTION OF THE PRIOR ART

In a conventional method of manufacturing a cathode ray tube for color TVs, a process for coating the inner surface of a panel P for a cathode ray tube with photosensitive materials of the three primary colors and exposing them by means of the panel and a reticulate shadow mask M which is mounted on the inner surface of the panel with a space therebetween, as shown in FIGS. 12 and 13, is repeated for each color. Every time the process is carried out, it is necessary to remove the mask M from the panel P and mount again the same mask M on the panel P by removing or inserting panel pins P' from or into panel pin holes H provided in flexible spring pieces M' which are attached to corresponding positions on the outer periphery of the mask M. The relative positions of the panel P and the mask M should be the same whenever the panel pins P' are inserted into the panel pin holes H, and therefore the operation of mounting the mask on the panel requires highly accurate mounting technique.

Various methods of mounting a mask on a panel with high accuracy have hitherto been developed. For example, Japanese Patent Publication Nos. 24343/1981 and 56177/1982 disclose a method of mounting a panel holder and a mask holder on the same carrier so as to enhance the accuracy of registering of the relative positions in mounting. Another method is disclosed in Japanese Patent Application Laid-Open No. 43338/1982. It is a method of removing a mask in correspondence with two or three kinds of tubes by detecting the outer diameters (the minor axis and the major axis) of the panel by means of a centering device, and regulating the stroke of a cylinder for holding and releasing the mask in accordance with the detection signal. Furthermore, Japanese Patent Publication No. 21144/1984 discloses a method of removing various kinds of masks from various kinds of panels by making the positions of the panel pins and the blades of a mask for pressing the spring leaves depending on kinds of tubes.

PROBLEMS TO BE SOLVED BY THE INVENTION

In most of these prior art methods, however, alignment of a panel and a mask in mounting is performed indirectly through the alignment of a panel holder and a mask holder. Since the panel and the mask are not aligned directly, it is necessary to mount the panel and the mask at the same positions on the panel holder and the mask holder, respectively, whenever they are mounted. Even if the panel and the mask are directly aligned, the alignment cannot deal with panels for various kinds of tubes of different sizes. Furthermore, even if alignment can deal with a few kinds of tubes, such as one to three kinds, since a link mechanism and so on are adopted, slight loose fit of a coupling pin during the operation of each link cannot realize highly accurat alignment.

Accordingly, it is an object of the present invention to provide an apparatus for mounting a shadow mask on a panel which is capable of sufficiently dealing with alignment of panels of various kinds of tubes and masks at the time of mounting and which is capable of directly aligning panel pins with the panel pin holes of the mask, thereby eliminating the defects in the prior art.

MEASURES FOR OVERCOMING THE PROBLEMS

The present invention provides an apparatus for mounting a shadow mask on a panel in an apparatus for manufacturing color picture tubes comprising:

elevating support posts for supporting the periphery of an inverted-cup-shaped shadow mask;

an elevating shadow mask centering mechanism which is outstretched toward the inner periphery of a shadow mask which is carried in while the periphery of the lower end being supported in the shape of an inverted-cup so as to prevent dust or the like adhering thereto; rotary rod arms each of which is provided on one of opposing aligning stands outside of the shadow mask centering mechanism and having a panel pin guide groove at the tip thereof, each said stand having a dummy pin with the center line of the guide groove being on the vertical line including the center of the tip of the dummy pin, the advancement and withdrawal of the dummy pin being controllable, and the distance between the opposing aligning stands being able to be increased or reduced; elevating mask holding means provided with pressing claw bodies which are able to advance and withdraw for clamping spring pieces attached to the outer periphery of the shadow mask and having panel pin holes which have been positioned by the insertion of the dummy pins, and V-claw bodies having V-grooves at the tips thereof for positioning the panel pin holes with dummy pin inserted thereinto so as to be in the right position opposite to corresponding panel pins, the distance between the opposite mask holding means being able to be increased or reduced; and panel centering rests for centering and placing thereon an inverted-cup-shaped panel which is carried in, the distance between opposing panel centering rests being able to be increased or reduced. The shadow mask is mounted on the panel by positioning panel pins which are provided protrudingly on the inner periphery of the panel by rotating upwardly the rotary rod arms so as to introduce the panel pins into the panel pin guide grooves, holding the positioned panel pins in the V-grooves of the V-claw bodies which are moved upward, withdrawing the pressing claw bodies which are clamping the spring pieces of the shadow mask having panel pin holes which have been positioned by the dummy pins, and inserting the panel pins into the panel pin holes by the resilient force of the spring pieces.

OPERATION

An apparatus according to the present invention aligns a mask with a panel in the following way. An inverted-cup-shaped mask whose periphery is supported by support posts which are situated at their upper limit is first lowered so as to cover a mask centering mechanism. The mask centering mechanism is outstretched so as to press against the inner peripheral edge of the mask, whereby the center of the mask supported by the support posts is aligned with the center of the center shaft of the mechanism so that each of later-described dummy pins is retained at a position where it can be inserted into a corresponding panel pin hole formed in an spring piece which is attached to the outer peripheral edge of the mask. The distance between opposing mask alignment means, the heights, and the positions of the mask alignment means are next adjusted in accordance with the size of the mask. The alignment means are moved so as to situate the dummy pins of the alignment means right opposite to the panel pin holes. The dummy pins are inserted into the respective panel pin holes, whereby the mask is aligned with the panel on the basis of the dummy pins.

The distance of opposing mask holding means and the positions of the mask holding means are adjusted in accordance with the size of the mask and the mask holding means is moved upward and stopped at the position where each of the dummy pin which is inserted into the panel pin hole comes into slight contact with a corresponding V-groove of a V-claw body. The pressing claw bodies of the mask holding means are then advanced so as to press and deform the respective spring pieces, thereby clamping the spring pieces between the pressing claw bodies so that the position of the mask is ensured on the basis of the dummy pins.

Thereafter, the dummy pins are withdrawn so as to be removed from the panel pin holes and the positioning in the X—Y direction, namely, positioning in the plane is completed.

The distance between an opposing pair of elevating roller conveyors which are situated at the upper limit is next increased or reduced in accordance with the size of the panel and the panel is carried in by driving the rollers.

The panel carried in stops when it hits against the protruding upper ends of the forwardmost panel centering rests, and the roller conveyors are lowered to the lower limit.

When the roller conveyors are lowered, the panel drops along the inclined surfaces of the panel centering rests, the distance of opposing rests being adjusted in accordance with the size of the panel, while the panel is centered at a mask mounting position and it is placed on the horizontal supporting surfaces of the rests.

Then panel pin positioning members which are attached to aligning stands are rotated upwardly so as to introduce the panel pins which are protrudingly provided on the inner periphery of the panel into the panel pin guide grooves of the members, whereby the positions of the X—Y direction of the panel pins are determined, the panel pin positioning members being thereafter rotated downwardly.

Since the dummy pins and the panel pin guide-grooves are provided such that the panel pin guide grooves of the panel pin positioning members are included in the vertical plane including the axes of the dummy pins, the panel pin holes of the mask which are positioned by the dummy pins and the panel pins which are positioned by the panel pin guide grooves are aligned in the X—Y direction on the basis of the dummy pins.

The mask with the spring pieces clamped by the pressing claw bodies is moved upward by the elevating operations of the support posts which are supporting the mask, the mask centering mechanism, and the mask holding mechanism. The upward movement of the mask is stopped when the V-groove surfaces of the V-claw bodies come into slight contact with the respective panel pins of the panel which has been positioned on the panel centering rests by the above-described operation. In other words, the positioning between the mask and the panel in the Z direction (in the direction of height) is performed at a position at which the V-groove surfaces of the V-claw bodies come into slight contact with the respective panel pins. Therefore, even if the positions in the Z direction at which panel pins are attached to the panel are different depending on the size of the panel, the position at which the upward movement of the mask is stopped is determined in correspondence therewith. Thus, it is possible to mount masks on panels of various kinds of tubes.

The pressing claw bodies are next gradually withdrawn so as to gradually restore the spring pieces which are attached to the outer peripheral edge of the mask to their original states. Since the positioning between the panel pins and the panel pin holes formed in the spring pieces of the mask has already been completed on the basis of the dummy pins, the panel pins are easily inserted into the panel pin holes of the spring pieces, thereby completing the mounting operation of the mask on the panel.

Thereafter, the mask centering mechanism is contracted inwardly to be out of contact with the inner peripheral edge of the mask, and the support posts which support the mask, the mask centering mechanism and the mask holding mechanism are lowered.

The pair of roller conveyors are elevated up to the upper limit, so that the panel with the mask mounted thereon is moved from the horizontal supporting surfaces of the panel centering rests onto the rollers of the conveyors.

When the upper end portions of the foremost panel centering rests are moved below the carrying surfaces of the conveyors and the rollers are driven, the panel with the mask mounted thereon is carried from the mounting position to the coating position, whereby a series of the operation of mounting the mask on the panel is completed.

Repetition of the above-described operation enables a mask to be mounted on a panel successively. Furthermore, since the apparatus of the present invention has mechanisms whose opposing distance, heights and positions are adjustable in accordance with the size of a cathode ray tube, the mask mounting operation is carried out for panels of various kinds of tubes without any trouble.

BRIEF DESCRIPTION OF THE DRAWINGS

The drawings show in combination an embodiment of the present invention, in which.

DESCRIPTION OF THE PREFERRED EMBODIMENT

Figure 1:
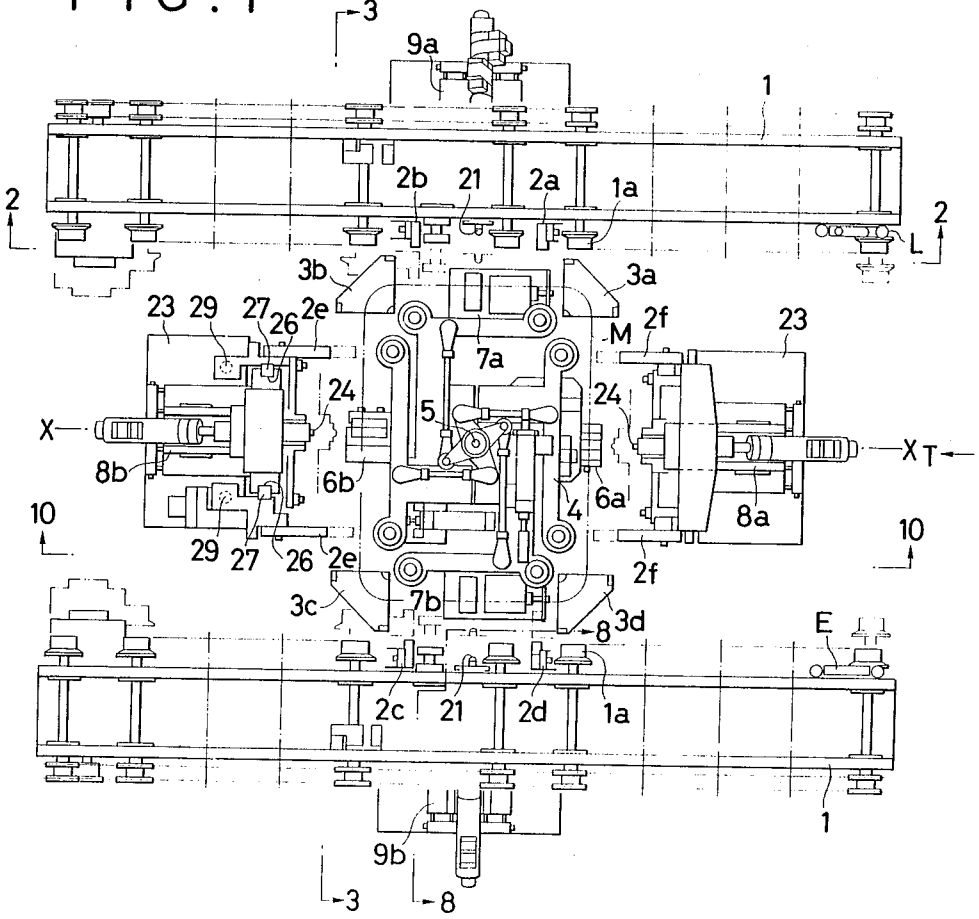
FIG. 1 is a schematic plan view of the embodiment.

FIG. 1 is a plan view of the arrangement of the elements of an embodiment of the apparatus according to the present invention. A pair of elevating roller conveyors 1 which are opposed in parallel to each other such that the distance therebetween is able to be freely increased or reduced. A multiplicity of rollers 1*a*, 1*a* . . . are attached to the opposing inner surfaces of the roller conveyors 1 which support and carry the peripheral edge of an inverted-cup-shaped panel P. Four panel centering rests 2*a*, 2*b*, 2*c* and 2*d* are disposed at the position at which the panel P is to be stopped for mask mounting operation. In the vicinity of the respective panel centering rests, four mask rests 3*a*, 3*b*, 3*c* and 3*d* are vertically movably provided so as to support the corner portions of the periphery at the lower end of an inverted-cup-shaped mask M.

At the center of the space surrounded by the four mask rests 3*a*, 3*b*, 3*c* and 3*d*, the center shaft 5 of a mask centering mechanism 4 for the inverted-cup-shaped mask M is disposed so as to vertically movably support the centering mechanism 4.

If the axis which passes through the center shaft 5 in parallel to the roller conveyors 1 is an abscissa X—X, and the axis which passes through the center shaft 5 orthogonally to the abscissa is an ordinate Y—Y, mask holding means 6*a*, 6*b* and 7*a*, 7*b* are provided at the symmetrical positions with respect to the abscissa and the ordinate, respectively. Mask alignment means 8*a*, 8*b* and 9*a*, 9*b* are disposed outside of the mask holding means 6*a*, 6*b* and 7*a*, 7*b*, respectively.

Figure 2:
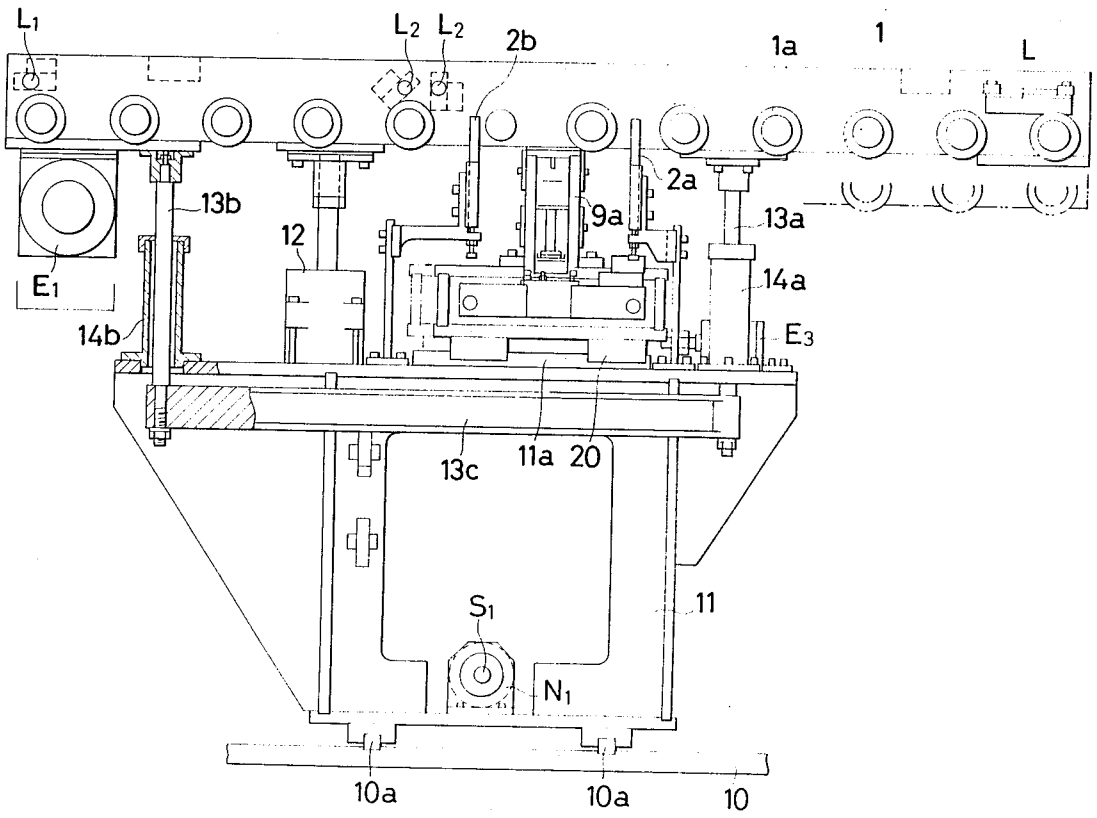
FIG. 2 is an enlarged elevational view of the embodiment shown in FIG. 1, taken along the line 2—2.

FIG. 2 is an elevational view of a conveyor support mechanism of one of the pair of roller conveyors 1, as viewed in the direction of the ordinate Y—Y, the other conveyor having the same structure.

The pair of conveyors 1 are vertically movably supported by cylinder devices 12 on a pair of movable stands 11 which are mounted on respective guide rails 10*a*, 10*a* for guiding the movable stands in the direction of the ordinate Y—Y on a base 10 attached to a bed F (shown in FIG. 3) on the floor. A pair of elevating guide rods 13*a*, 13*b* which are provided apart from the conveyor 1 are inserted into slide guides 14*a*, 14*b* erected on the movable stand 11, and the lower ends of the guide rods 13*a*, 13*b* are connected with each other by connecting rod 13*c*. When the cylinder device 12 is operated, the roller conveyor 1 is guided by the slide guides 14*a*, 14*b* so as to be elevated or lowered while being held in a horizontal state. A motor $E_1$ for controlling the carrying speed of the rollers 1*a* is attached to the roller conveyor 1 (see FIG. 2).

A nut $N_1$ which is engaged with corresponding one of the right and left screws of a screw shaft $S_1$ is fixed on the movable stand 11. When the screw shaft $S_1$ is rotated by a motor $E_2$ provided on the base 10 (see FIG. 3), the pair of movable stands 11 slide along the guide rails 10*a* in the opposite directions to each other, thereby enabling the distance between the roller conveyors to be increased or reduced.

Panel centering rests 2*a*, 2*b* are erected on the movable stand 11 and an alignment means 9*a* for aligning the panel and the mask at the time of mounting is mounted on a guide rail 11*a* provided on the movable stand 11 for guiding the alignment means in the direction of abscissa. It is possible to change the position of the alignment means 9*a* in the direction of the abscissa X—X by means of a control cylinder $E_3$ (see FIG. 2).

A panel guide roller L is attached to the conveyor 1 on the side for carrying a panel in, an optical switch L is attached to the side for carrying a panel out, and an optical switch $L_2$ is attached in the vicinity of a position where a panel is to be stopped, thereby detecting the operation of carrying a panel in and out.

Figure 3:
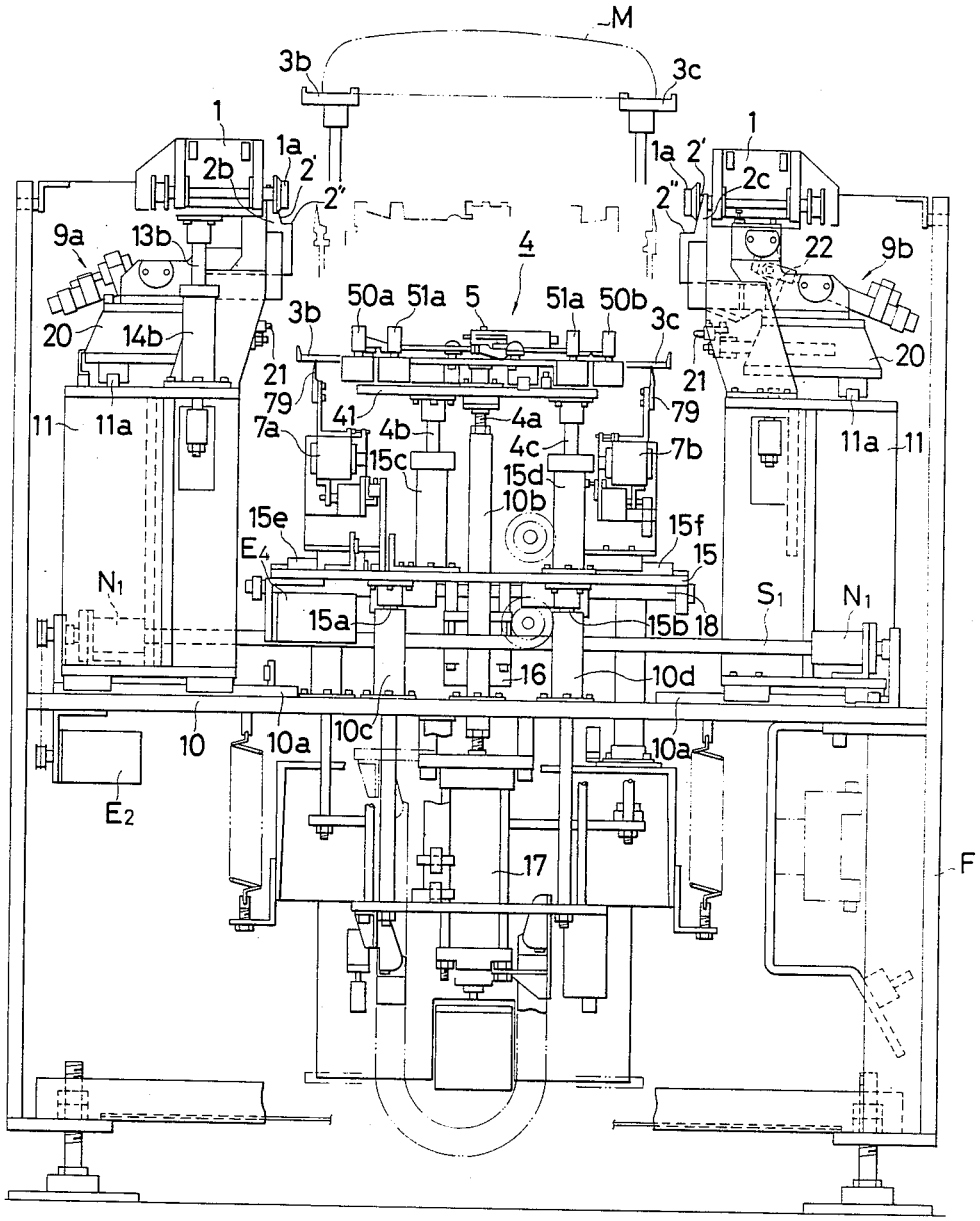
FIG. 3 is an enlarged elevational view of the embodiment shown in FIG. 1, taken along the line 3—3.

FIG. 3 is a side elevational view of the apparatus shown in FIG. 1 except for the mask alignment means 8*a*, 8*b*, as viewed in the direction of the abscissa X—X. A central sliding guide cylinder 10*b* with an elevating sliding support post 4*a* of the mask centering mechanism 4 inserted thereinto and a pair of sliding guide posts 10*c*, 10*d* which are disposed below the under surface of an elevating plate 15 with a space therebetween are erected at the center of the upper surface of the base 10. The elevating plate 15 is provided with the mask holding means 7*a*, 7*b* and elevating sliding support posts 15*a* and 15*b* are inserted into the sliding guide posts 10*c* and 10*d*, respectively. A pair of sliding guide cylinders 15*c* and 15*d* with guide rods 4*b* and 4*c*, respectively, which are suspendingly provided on the mask centering mechanism 4, inserted thereinto are erected at the center of the upper surface of the elevating plate 15. The distance between the upper end of the guide cylinders 15*c*, 15*d* and the under surface of the mechanism 4 is h. A cylinder device 16 having a short stroke length is suspended from the under surface of the elevating plate 15 in such a manner that the end of the piston rod of the cylinder device 16 is connected to the end of a cylinder device 17 which is suspended from the under surface of the base 10 and has a long stroke length. The mask centering mechanism 4 is supported by the upper end of the guide cylinder 10*b* with the sliding support post 4*a* inserted thereinto while neither of the piston rods of the cylinder devices 16 and 17 is extended. If the piston rod of the cylinder device 17 along is extended in this state, only the elevating plate 15 is elevated, and when it is elevated by the length h, the upper ends of the sliding guide cylinders 15*c*, 15*d* hit against the under surface of the mask centering mechanism 4, thereby pushing the mechanism 4 up. The mask centering mechanism 4 is thereby elevated together with the elevating plate 15, which is stopped when it is elevated by the length corresponding to the stroke length of the cylinder device 17. On the other hand, if the piston rod of the cylinder device 16 is extended, the elevating plate 15 is elevated by the length h without elevation of the centering mechanism 4.

If both cylinder rods 16 and 17 are operated, the elevating plate 15 is elevated by the length corresponding to the sum of the stroke lengths of both cylinder devices 16, 17.

The mask holding means 6*a*, 6*b* disposed in the direction of the abscissa X—X have a similar structure, and explanation thereof will be omitted.

MASK CENTERING MECHANISM

Figure 4:
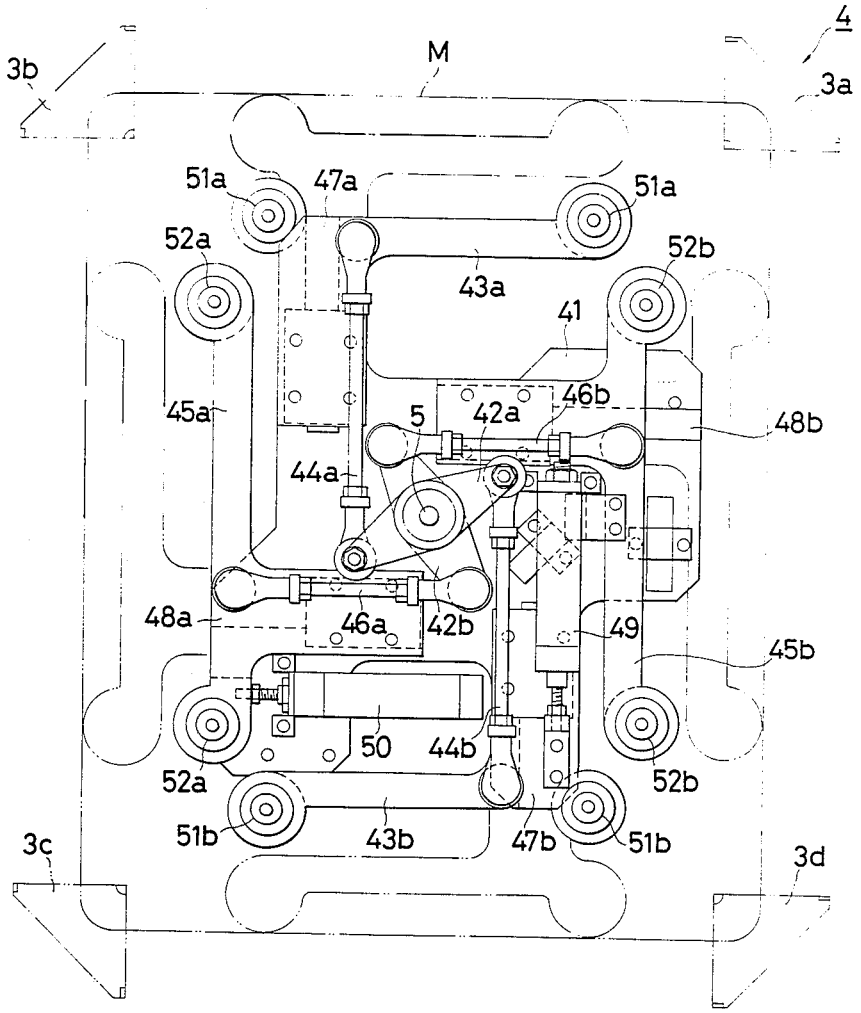
FIG. 4 is an enlarged plan view of a mask centering mechanism.
Figure 5:
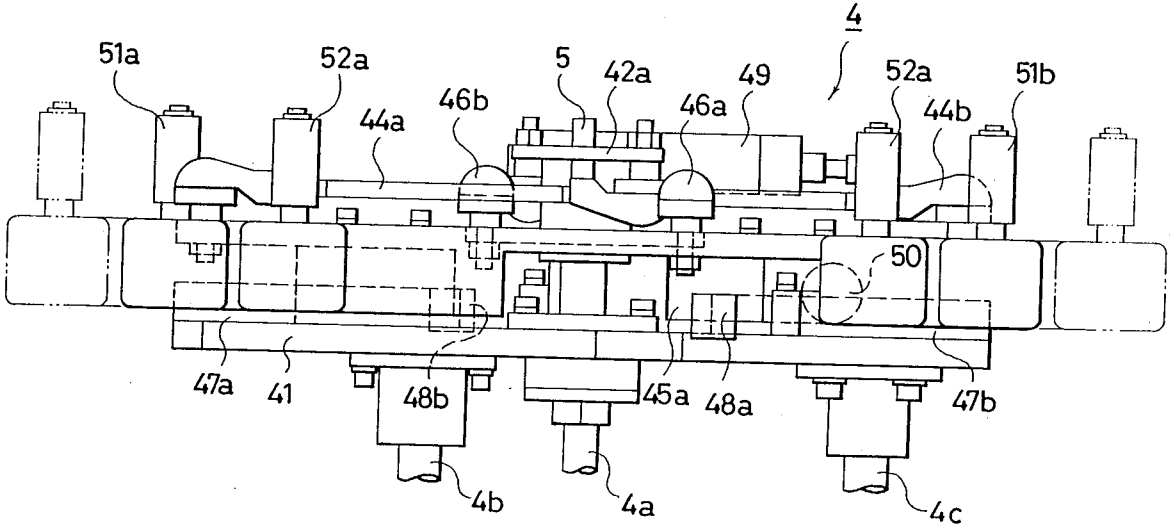
FIG. 5 is a left side elevational view of the mask centering mechanism shown in FIG. 6.

The mask centering mechanism 4 will be described in detail with reference to a plan view of FIG. 4 and a left side elevational view of FIG. 5.

The center shaft 5 is erected on the upper surface of an adapter plate 41 of the centering mechanism 4 and two rotary links 42*a* and 42*b* are rotatably placed on the center shaft 5 for independent rotation. Both ends of one of the rotary links (42*a*) which are equidistant from the center shaft 5 are connected to lateral centering members 43*a* and 43*b*, respectively, which are movable in the direction of the ordinate Y—Y by means of lateral connecting pipes 44*a* and 44*b*, respectively, of the same length. Both ends of the other of the rotary links (42*b*) which are equidistant from the center shaft 5 are connected to longitudinal centering members 45*a* and 45*b*, respectively, which are movable in the direction of the abscissa X—X by means of longitudinal connecting pipes 46*a* and 46*b*, respectively, of the same length. The lateral centering members 43*a*, 43*b* are guided by lateral guide members 47*a* and 47*b*, respectively, which are provided on the adapter plate 41, the longitudinal centering members 45*a*, 45*b* being guided by longitudinal guide members 48*a* and 48*b*, respectively, which are provided on the adapter plate 41, the longitudinal guide members 48*a* and 48*b*, respectively, which are provided on the adapter plate 41. The piston rods of the two cylinder devices 49, 50 attached on the adapter plate 41 are connected to the lateral centering member 43*b* and the longitudinal centering member 45*a*, respectively.

When the piston rods of the two cylinder devices 49, 50 are extended, each pair of the centering members 43*a*, 43*b* and 45*a* and 45*b* is moved outwardly such as to increase the distance therebetween, whereby pairs of vertical spindle rollers 51*a*, 51*a*, 51*b*, 51*b* and 52*a*, 52*a*, 52*b*, 52*b* which are attached to the respective centering members with a space therebetween are brought into contact with the inner periphery of the inverted-cup-shaped mask M with the corner portions supported by the four mask support rests 3*a*, 3*b*, 3*c* and 3*d*, as indicated by the broken lines. In this way, the positions at which the mask is supported are aligned with a reference position with the center shaft 5 as the center. Therefore, centering is conducted by increasing the distance between each pair of centering members until they come into contact with the inner periphery of the mask, even if the specification dimension is varied, thereby enabling mask centering for various kinds of tubes.

MASK HOLDING MEANS

The pair of mask holding means 7*a*, 7*b* (see FIG. 3) are slidably mounted for guiding in the direction of the ordinate Y—Y on the guide members 15*e* and 15*f* respectively, which are provided on the elevating plate 15 and opposed to each other with a space therebetween. The distance between the pair of mask holding means 7*a*, 7*b* is controlled so as to be increased or reduced along the guide members 15*e*, 15*f* by the operation of a control motor $E_4$.

Figure 6:
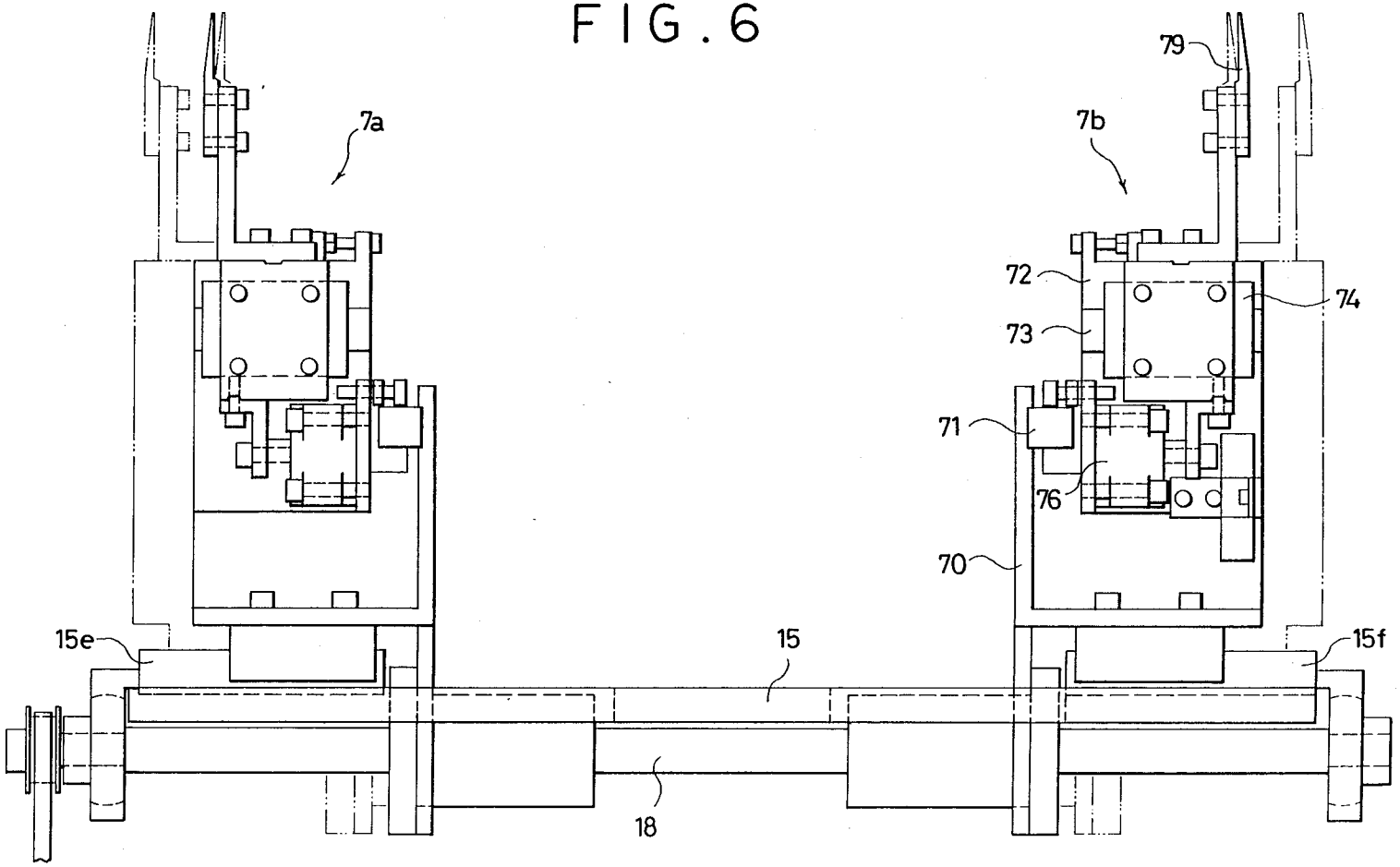
FIG. 6 is an enlarged side elevational view of a mask holding means disposed in the direction of the ordinate.

The pair of mask holding means 7*a*, 7*b* will be explained in detail with reference to the side elevational view of FIG. 6 and the elevational view of FIG. 7. Since they have the same structure, only the mask holding means 7*b* will be explained.

The mask holding means 7*b* is provided with a frame body 70 which is slidable in the direction of the ordinate Y—Y along the guide member 15*f*, the frame body being engaged with a screw shaft 18 which is horizontally installed on the elevating plate 15; a V-claw holding frame 72 which is slidable along a guide member 71 for guiding in the direction of the abscissa X—X which is provided on the frame body 70; and a pressing claw holder 74 which is slidable along a guide member 73 for guiding in the direction of the ordinate Y—Y which is provided on the frame body 72. The V-claw holding frame 72 is moved in the direction of the abscissa X—X by the operation of a cylinder 75 which is attached to the frame body 70, while the pressing claw holder 74 is moved in the direction of the ordinate Y—Y by the operation of a cylinder 76 which is attached to the V-claw holding frame 72.

The V-claw holding frame 72 is provided with a V-claw body 78 with a Y-groove 77 formed at the tip so as to oppose the panel pin hole to the panel pin, thereby aligning the positions of the panel and the mask at the time of mounting.

A pressing V-claw body 79 for inserting and removing the panel pin into and from the panel pin hole by pressing and deforming the spring piece M' which is provided on the outer periphery of the mask and for holding the mask is attached to the pressing claw holder 74 in close proximity to the V-claw body 78.

Thus, it is possible to adjust the distance between the opposing pair of mask holding means 7*a*, 7*b* in correspondence with the size of a mask which is different depending on the kind of a tube and to locate the mask holding means at the right positions opposite to the mounting positions of the spring pieces M' which are different depending on the kind of a tube.

The press claw bodies 79 press and deform the spring members which have the panel pin holes so as to remove the panel pins from the respective panel pin holes or to facilitate the insertion of the panel pins by moving on the Y-claw holding frames 72 so as to reduce the distance in the direction of the ordinate Y—Y between the mask holding means, and clamp the mask.

MEANS FOR MOUNTING MASK TO PANEL

The distance in the direction of the ordinate Y—Y of the pair of movable stands 11 shown in FIG. 3, which are movable in the direction of the ordinate Y—Y, is increased or reduced by the screw shaft $S_1$ having the threads which are oriented clockwise and counterclockwise, respectively, by the operation of the motor $E_2$ attached to the base 10, whereby the distance between the conveyor 1 and the panel centering rests 2*a*, 2*b* (see FIG. 2) which are fixed on the one stand 11 and the conveyor 1 and the panel centering rests 2*c*, 2*d* which are fixed on the other stand 11 is increased or reduced in accordance with a change in the dimension of a panel of each kind, thereby enabling centering for panels P of different dimensions.

When the panel P carried on the rollers 1*a* of the opposing conveyors 1 with the distance therebetween adjusted in correspondence with the dimension of the panel P is stopped at a predetermined position, the pair of conveyors 1,1 are lowered below the panel centering rests 2*a*, 2*b*, 2*c* and 2*d* by the reducing operation of the cylinder devices 12, so that the inverted-cup-shaped panel P on the rollers 1*a* is moved onto and supported by the panel centering rests 2*a*, 2*b*, 2*c* and 2*d*.

Since each of the panel centering rests 2*a* to 2*d* consists of continuous surfaces of an inwardly inclined surface 2' and a horizontal supporting bottom 2'', the panel P is lowered along the inclined surface 2' toward the center and is supported by the horizontal supporting bottom 2".

Each of the mask alignment means 9a, 9b which are disposed in the direction of the ordinate Y—Y is provided with an aligning stand 20 which is moved on the movable stand 11 along the guide rail 11a in the direction of the abscissa X—X by the operation of the cylinder $E_3$, a movable dummy pin 21 which is attached to the aligning stand 20 and a panel pin positioning member 22.

Since the mask alignment means 9a, 9b have the same structure, only the alignment means 9a will be explained with reference to the side elevational view of FIG. 8 and the plan view of FIG. 9.

The movable dummy pin 21 is advanced and withdrawn by the operation of a cylinder 21c. The dummy pin 21 is inserted into the panel pin hole H which is provided in the spring piece M' of the mask M at the forward end of its stroke as indicated by the chain line in FIG. 8 and is removed from the panel pin hole at the rear end of its stroke as indicated by the solid line in FIG. 8.

The panel pin positioning member 22 is vertically rotated by the operation of a cylinder 22c which is movably supported by a rotary rod arm 22a with the base end rotatably supported by the aligning stand 20. The lower limit of the rotation of the rotary rod 22a is indicated by the solid line and the upper limit by the chain line. The movable dummy pin 21 and the panel guide groove 22b are accurately positioned in advance such that the center line of a panel pin guide groove 22b which is vertically provided on the surface of the panel pin positioning member 22 and the center of the movable dummy pin 21 are included in the same vertical plane.

In this way, when the panel pin positioning member 22 is rotated upwardly so as to introduce the panel pin P' which is protrudingly provided on the inner peripheral surface of the inward-cup-shaped panel P which is supported by the panel centering rests 2a to 2d into the panel pin guide groove 22b, the panel P is located at the accurate mask mounting position. The forward end of the movable dummy pin 21 is then inserted into the panel pin hole H, whereby the mask M which is supported by the mask rests 3a, 3b is located at the accurate mounting position in the direction of Y—Y. The centers of the panel pin P' of the panel P and the panel pin hole H which are respectively positioned accurately are thus included in the same vertical plane.

The mask alignment means 8a, 8b which are disposed in the direction of the abscissa X—X have the same structure as the mask alignment means 9a, 9b and are provided with respective movable dummy pins 24 and panel pin positioning member 25.

Figure 10:
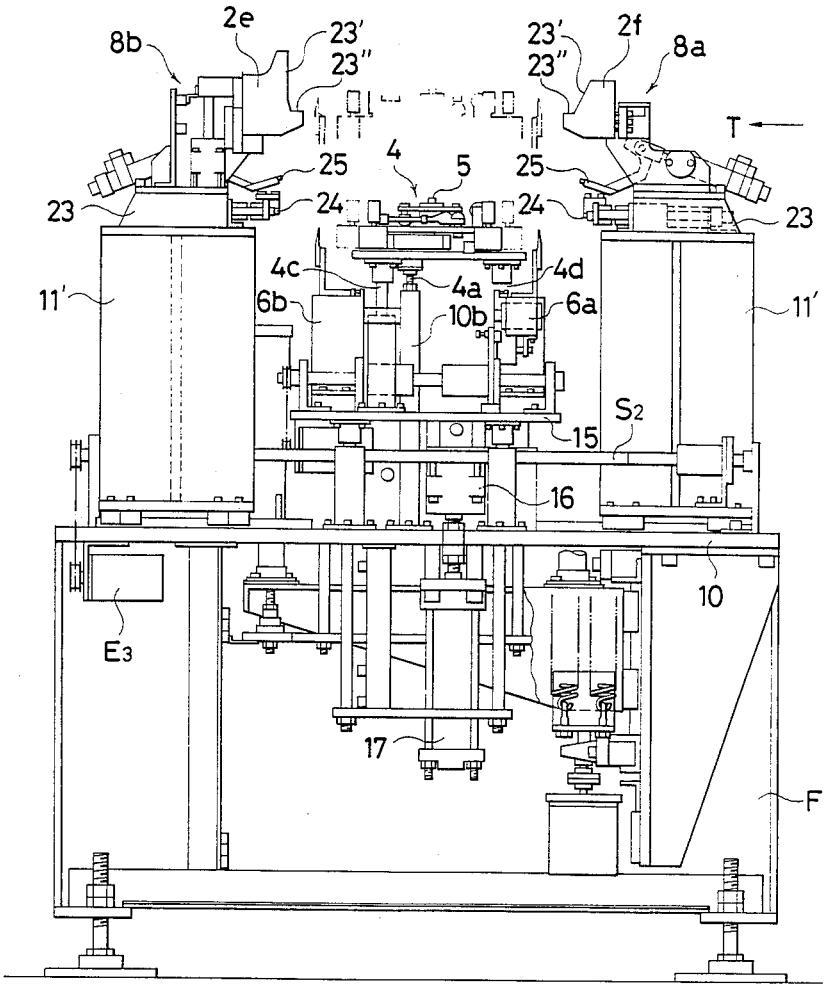
FIG. 10 is an enlarged elevational view of the embodiment shown in FIG. 1, taken along the line 10—10.

FIG. 10 shows the mask alignment means 8a, 8b, as viewed in the direction of the ordinate Y—Y. The panel P is carried in from the direction T by the roller conveyors 1.

A pair of movable stands 11',11' which are movable in the direction of the abscissa X—X on the rail of the base 10 are moved simultaneously in the opposite directions by a ball screw shaft $S_2$ which is driven by a motor $E_5$ so as to be adjusted in accordance with a change in the dimension of a panel.

Figure 7:
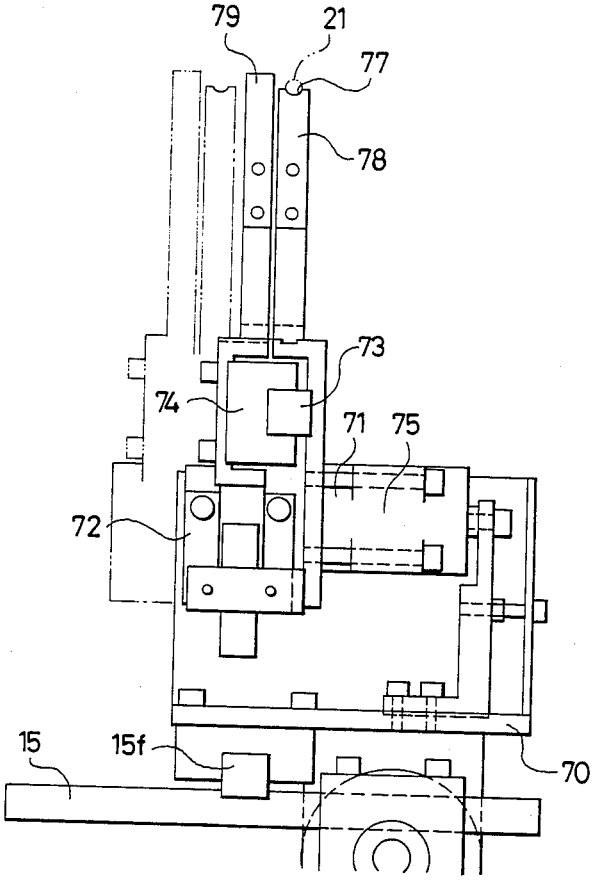
FIG. 7 is an elevational view of the mask holding mechanism shown in FIG. 6.
Figure 8:
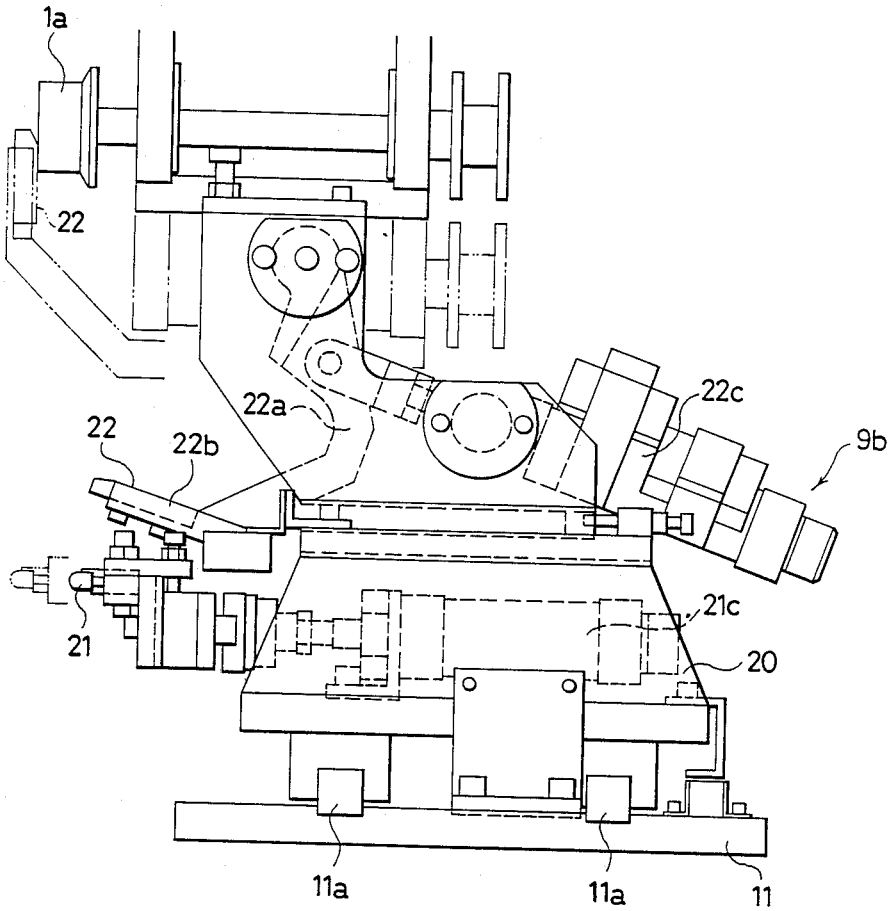
FIG. 8 is an enlarged side elevational view of the embodiment shown in FIG. 1, taken along the line 8—8.
Figure 9:
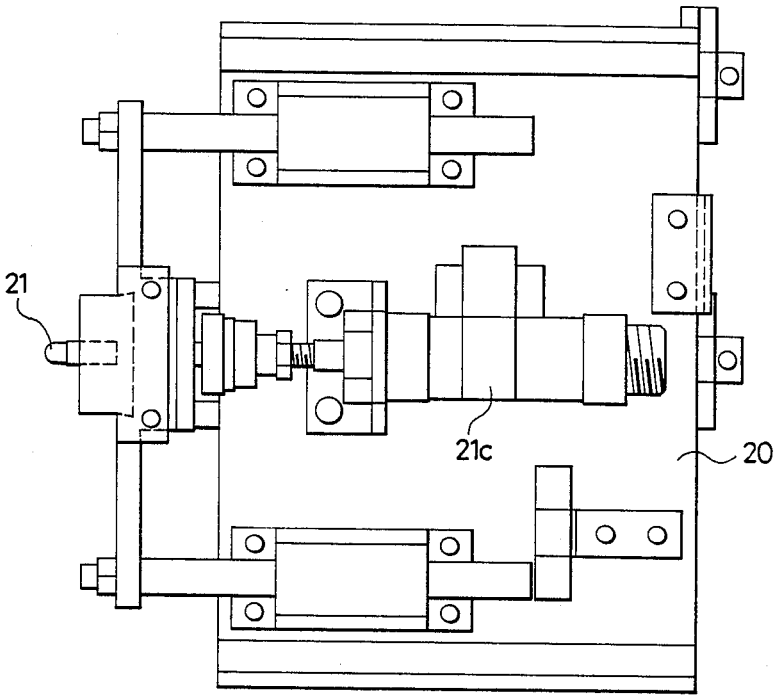
FIG. 9 is a plan view of a movable dummy pin shown in FIG. 8.

On each of the movable stands 11',11' an aligning stand 23 is fixed and the movable dummy pin 24 and the panel pin positioning member 25 having similar function and operation to those of the movable pin 21 and the panel pin positioning member 22 shown in FIGS. 7 and 8 are fixed on the aligning stand 23.

On both sides of the aligning stands 23, 23 are attached panel centering rests 2e and 2f, respectively, each of which consists of continuous surfaces of an inwardly inclined surface 23' and a horizontal supporting bottom 23", as is the case with the panel centering rests 2a to 2d. The forwardmost panel centering rests 2e are situated forward of (the lefthand side in FIG. 10) the other panel centering rests 2f in the direction indicated by the arrow T in which the panel P is carried in. The rests 2e are attached to the aligning stand 23 such that the upper ends thereof are vertically adjustable from the height above the carrying surfaces of the conveyors 1 to the height below the carrying surfaces of the conveyors 1 at the upper limit for carrying the panel. The upper ends of the rests 2f are situated below the position at which the panel is carried in by the conveyors 1.

Therefore, the panel P which is carried in the direction indicated by the arrow T by the roller conveyors 1 passes the nearer panel centering rests 2f and hits against the upper ends of the forwardmost panel centering rests 2e and is thereby stopped. When the panel P with the mask M mounted thereon is carried out by the roller conveyors 1, the panel centering rests 2e are moved such that the upper ends thereof are below the carrying surfaces of the roller conveyors 1, thereby allowing the panel P to be carried out without any trouble.

Figure 11:
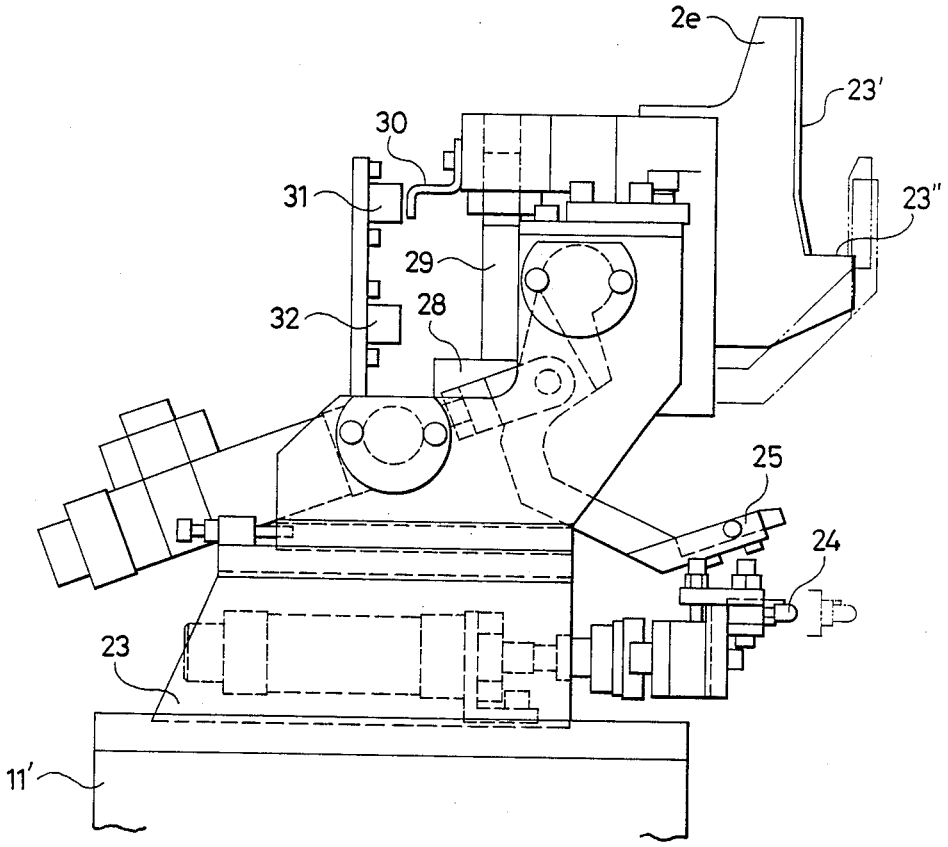
FIG. 11 is an enlarged elevational view of the left-hand aligning means shown in FIG. 10.
Figure 12:
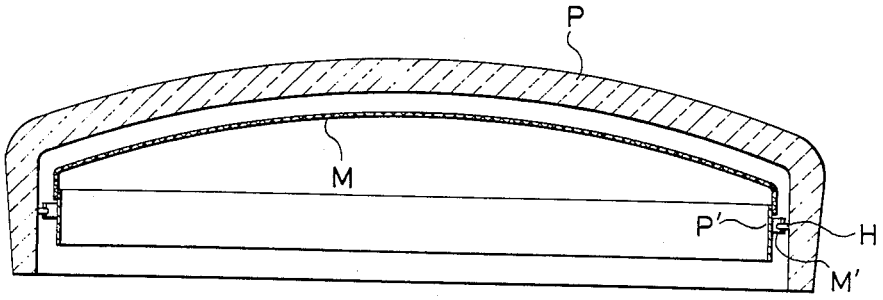
FIG. 12 is a sectional view of a panel with a mask mounted thereon.
Figure 13:
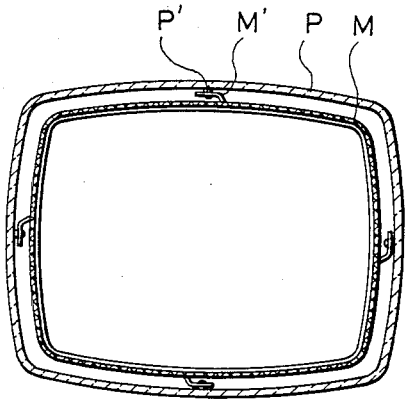
FIG. 13 is a bottom plan view of the panel shown in FIG. 12.

FIG. 11 is an elevational view of the panel centering rest 2e, the plan view thereof being shown on the lefthand side of FIG. 1.

The panel centering rest 2e will be explained with reference to FIGS. 1, 10 and 11.

On both sides of the aligning stand 23 fixed on the movable stand 11' guide grooves 26,26 for guiding in the direction of the ordinate are provided, as shown in FIG. 1, and a pair of guide members 27, 27 which are fixed on the pair of panel centering rests 2e are slidably inserted into the guide grooves 26, 26. The forward end of a piston rod 29 of a cylinder 28 which is attached to the aligning stand 23 is connected to the panel centering rest 2e. An actuating piece 30 which is attached to the rest 2e energizes neighboring switches 31, 32 which are attached to the aligning stand 23 with a vertical space therebetween, thereby controlling the extending and contracting operation of the cylinder 28 so as to move the rest 2e to the upper limit and the lower limit.

EXPLANATION OF THE OPERATION

The operation of mounting the mask on the panel will now be described in detail in order.

The mask M which is carried in the form of an inverted-cup by a holding and carrying device (not shown) is placed on the mask rests 3a to 3d at their elevated positions (see FIG. 3), the mask rests being provided between the pair of elevating roller conveyors 1,1 which are provided in parallel to each other with a space therebetween. Projections are provided at appropriate positions of the inner and outer periphery of the rests 3a to 3d so as to prevent the mask M from slipping off the rests.

The rests 3a to 3d which support the peripheral end portion of the lower end of the inverted-cup shaped mask M are lowered to the position of the mask centering mechanism 4, as shown in FIG. 3.

The mask centering mechanism 4 is therefore situated inside the inverted-cup-shaped mask.

The mask centering mechanism 4 is then outstretched in such a manner as to press the inner periphery of the mask, wnereby the periphery of the mask is moved on the rests *3a* to *3d* and is held at the centering position on the basis of the center shaft 5.

Since the mask centering mechanism 4 conducts the centering operation by pressing the inward surface of the mask when it is outstretched, it is possible to conduct the centering operation irrespective of a change in the dimension of a mask and it is also possible to engage or remove the spring pieces M' with or from the panel pins P' without any trouble.

The distance between the pair of movable stands 11, 11 shown in FIG. 3 and the distance between the pair of movable stands 11', 11' shown in FIG. 10 and 11 are next adjusted so as to be increased or reduced in correspondence with the dimension of the mask, and the aligning stands 20, 20 on the respective movable stands 11, 11 are moved in the direction of the abscissa X—X so as to oppose the movable dummy pins 21, 21 to the panel pin holes H of the spring pieces which are attached to the outer periphery of the mask on the mask rests *3a* to *3d*.

The movable dummy pins 21, 21 which are located at the right opposite positions to the corresponding panel pin holes are advanced to the positions indicated by the chain line in FIG. 8 by the extending operation of the cylinders 21*c* and are inserted into the respective panel pin holes H of the spring pieces.

The movable pins 24, 24 attached to the alignment stands 23, 23 which are fixed on the movable stands 11', 11' are thereafter advanced so as to be inserted into the respective panel pin holes H of the spring pieces which are attached on the other side of the outer periphery of the mask.

The spring pieces having the respective panel pin holes are attached to three or four sides of the outer periphery of the mask, the number of sides where the spring pieces attached being different depending upon the dimension of the mask. The mask M is accurately positioned on the basis of the dummy pins 21, 21 when they are inserted into the respective panel pin holes H of the spring pieces.

In other words, the centering operation conducted by the mask centering mechanism 4 on the basis of the center shaft 5 is a preliminary operation for positioning the mask in the vicinity of the positions at which the dummy pins 21, 21 are inserted. That is, the centering operation reduces the minute adjustment of the aligning stands 20, 20 to the minimum operation.

The dummy pins 21, 21 and 24, 24 are inserted so as to accurately position the mask M.

The distance between the mask holding means *6a, 6b* and the distance between the mask holding means *7a, 7b,* which are shown in FIGS. 3, 6, 7 and 10 are increased or reduced in correspondence with the dimension of the mask. When the elevating plate 15 is elevated by extending the cylinder device 16, the V-claw bodies 78 and the pressing claw bodies 79 of the respective mask holding means *6a, 6b* and *7a, 7b* are moved upward. The V-claw holding frames 72 are moved directly under the dummy pins 21, 21 and 24, 24 by the operation of the cylinders 75 and the V-grooves 77 of the V-claw bodies 78 come into slight contact with the dummy pins 21, 21 and 24, 24 which are inserted into the respective panel pin holes of the spring members from below, while the pressing claw bodies 79 are located in proximity to the outside of the spring pieces. During this time, the mask centering mechanism 4 is not moved upward but remains still.

When the cylinder devices 76 are moved so as to reduce the distance between the opposing pressing claw holders 74, the spring pieces M' are pressed and deformed, thereby removing the dummy pins 21, 21 and 24, 24 from the respective panel pin holes H. After the dummy pins are removed, they are withdrawn by the operation of the cylinders.

The panel P is carried in from the direction T while being placed in the form of an inverted-cup on the upper surfaces of the rollers 1*a* provided on the inside of the pair of elevating roller conveyors 1,1 which are provided in parallel to each other with a space therebetween, as shown in FIG. 1, and the panel P is stopped when it is hit against the upper end members of the forwardmost panel centering rests 2*e* which protrude from the carrying surfaces of the conveyors 1.

When the panel P is stopped, the roller conveyors 1 are lowered by the contracting operation of the cylinder devices 12, as is clear from FIG. 2. Since the carrying surfaces of the conveyors 1 are situated below the horizontal supporting bottoms of the panel centering rests *2a* to *2f* when the conveyors 1 are stopped, the inverted-cup-shaped panel P on the conveyors 1 is introduced to the inwardly inclined surfaces and is lowered to the horizontal supporting bottoms while being centered.

The panel pin positioning members 22, 22 (see FIG. 8) and 25, 25 (see FIG. 10) which are provided on the aligning stands 20, 20 and 23, 23, respectively, are rotated upwardly so as to introduce the panel pins P' into the panel pin guide grooves which are formed in the panel pin positioning members 22, 22 and 25, 25, thereby positioning the mask mounting position of the panel. Thereafter, the panel pin positioning members 22, 22 and 25, 25 are rotated downwardly to return to their original positions.

The cylinder 17 is next extended to elevate the elevating plate 15, thereby elevating the mask centering mechanism 4 and the mask holding means *6a, 6a* and *7a, 7b* to the position indicated by the chain lines in FIGS. 3 and 10. The mask M is thereby elevated with the spring pieces M' clamped by the pressing claw holders 79, and the panel pins P' are inserted into the V-grooves of the V-claw bodies 78 and held by them from below.

Since each of the dummy pins 21, 21 and 24, 24 and each of the panel pin positioning members 22, 22 and 25, 25 are provided such that the center of the forward end of the dummy pin and the center of the corresponding panel pin guide groove is situated in the same vertical plane, the V-grooves at the forward ends of the V-claw bodies 78 are ready to receive the panel pins P'.

Thus, the panel pin hole H formed in the spring piece M' which is attached to the outer periphery of the inverted-cup-shaped mask M and the panel pin P' which is attached to the inner periphery of the inverted-cup-shaped panel P are positioned on the basis of the same V-claw body 78.

Since the panel P and the mask M now assume the state in which the mask M is ready to be mounted on the panel P by the panel pins P' of the panel which are inserted into the V-grooves of the V-claw bodies 78 from below and the mask pieces M' which are clamped by the pressing claw bodies 79, if the pressing claw bodies 79 are gradually withdrawn outwardly by the operation of the cylinders 76 shown in FIG. 6, the spring pieces which are clamped and deformed gradually resiliently outwardly and are restored to their original state, whereby the panel pin holes H formed on the spring pieces are engaged with the panel pins P' which have been in the standing state. Thus, the operation of mounting the mask on the panel is completed.

When the mask M is mounted on the panel P, the mask centering mechanism 4 is contracted inwardly so as to be out of contact from the inner periphery of the mask, and the elevating plate 15 is lowered by the contracting operation of the cylinder 17, so that the panel with the mask mounted thereon is placed and supported on the panel centering rests *2a* to *2f*.

The pair of elevating roller conveyors 1, 1 are then elevated by the elevation of the cylinders 12 own in FIG. 2, and are stopped when the carrying surfaces of the conveyors 1, 1 which carry the panel P with the mask M mounted thereon reach the position from which the panel has been carried in, namely, the position above the mask rests *2a to 2f*.

The panel centering rests *2e* shown in FIG. 11 are next lowered by the lowering operation of the cylinders 28 so as to enter below the under surfaces of the carrying surfaces of the conveyors 1, 1, thereby driving the rollers *1a* of the conveyors 1, 1 so as to carry out the panel with the mask mounted thereon.

One cycle of the process for mounting a mask on a panel comprising the steps of carrying in the mask and the panel, positioning them on the same basis, mounting the mask on the panel, and carrying out the panel with the mask mounted thereon has been explained above. Repetition of this cycle enables the three primary colors to be accurately coated on the inner surface of a panel, one color at one time, and to be baked. Furthermore, as described above, it is possible to adjust the distance between the opposite members of each means so as to be increased or reduced in correspondence with the dimensions of a panel and a mask.

To summarize the operation of the apparatus to mount a shadow mask within the tube panel to enable repeated removal and replacement, the panel P is placed into position overlying the shadow mask M so that the inwardly-directed pins P' on the interior of the panel are in general vertical registry with the apertured spring elements M' about the outer periphery of the shadow mask. An alignment stand *9a, 9b* is provided for each spring element to vertically align each spring element M' with its corresponding panel pin. Each alignment stand includes a dummy pin 21 which may be inserted into the aperture of the spring element M' of the shadow mask and a rod arm or V-claw body 78 having a guide groove 77 which may be raised so that at its upper limit position the arm provides guide grooves in which the inwardly projecting pins of the panel may be engaged. Clamping elements 79 alongside with upwardly facing V-shaped grooves 77 are provided to engage the element M' alongside the dummy pin 21 and be displaced toward the mask so as to deflect the springs members inwardly to disengage the dummy pins which are then retracted. The panel pins P' have been aligned vertically with the grooves 77 in the body 78 by the panel positioning members 22 which have guide grooves *22b* in the same vertical plane as the dummy pins 21. The grooves *22b* properly position the panel P when it is in position overlying the shadow mask. The members 22 are withdrawn before the mask is raised into the panel. The mask with the spring elements deflected inwardly is then raised until the V-shaped grooves of the members 78 engage the panel pins P' so that the clamp 79 may be withdrawn allowing the spring members to engage the panel pins P' to provide a proper mount.

ADVANTAGES OF THE INVENTION

According to the present invention, since a mask is mounted on a panel which is carried in separately from the mask by positioning the dummy pins and the panel pins which have their centers in the same vertical plane by the same V-grooves of the V-claw bodies, the relative mounting positions of the panel 25 and the mask always accurately agree even if the mask is repeatedly mounted or removed on or from the panel. Therefore, coating of the three primary colors, one color at one time, is enabled without any deviation, thereby greatly improving the efficiency of the color picture tube. In addition, since the positions of a centering mechanism, alignment mechanism, and mounting means for a panel and a mask and the distance of each opposite member thereof are variable and adjustable, the mounting operation is easy in manufacturing color picture tubes of various kinds in correspondence to difference sizes of panels and masks.

I claim:

1. For use in manufacturing color picture tubes, apparatus for mounting an inverted cup-shaped shadow mask in a cup-shaped panel having at least three pins mounted on the interior periphery respectively projecting horizontally inward within the panel, said mask having at least three spring pieces on its outer periphery, each piece having a panel-pin hole adapted to register with and receive a corresponding one of said panel pins to accurately mount said mask on said panel for removal: and replacement;

means to support said cup-shaped panel inverted with its pins horizontal;

elevating support posts for supporting the periphery of said shadow mask below said panel support means;

an elevating mask-centering mechanism which is engageable with the inner periphery of said shadow mask which is supported by said support posts to position said spring pieces in vertical alignment with said corresponding panel pins;

opposing aligning stands outside of said shadow mask centering mechanism, each stand having a rod arm with a panel-pin guide groove at the tip thereof, said arm being movable to and from an upper position in which the center line of said groove is in a horizontal position to receive the corresponding panel pin, each stand also having a dummy pin with its center line parallel to and in the same vertical plane as the center line of the panel-pin guide groove of said arm in said upper position, control means to effect the advancement and withdrawal of said dummy pin, said stands having means to increase and decrease the distance between said opposing aligning stands;

elevating mask-holding means provided with opposing claw bodies which are able to advance and withdraw for clamping the spring pieces having panel-pin holes, when said mask has been positioned by the insertion of said dummy pins into said panel-pin holes, said claw bodies having V-grooves at the tips thereof adapted to register with said panel-pin holes and with the dummy pin inserted thereinto, means to adjust said claw bodies into the right position for registering with corresponding dummy pins, clamp means to decrease and increase the distance between the opposing mask holding means, upon decrease of the distance, the spring pieces being displaced inwardly relative to said dummy pins to disengage the dummy pins from their corresponding panel-pin holes; and panel-centering rests for centering said inverted panel, the distance between opposing panel-centering rests being able to be increased or reduced, whereby upon movement of said rod arm upwardly into said upper position, the panel pins of said panel may be displaced into vertical registry with said panel-pin guide grooves to engage therein;

wherein said shadow mask is mounted on said panel by moving said mask vertically upwardly while said spring pieces are clamped until the panel pins are positioned in said V-grooves of said claw bodies, and then withdrawing said claw bodies, thereby inserting said panel pins into said panel-pin holes by the resilient force of said spring pieces.

2. Apparatus according to claim 1 wherein said rod arm is mounted for rotation on a horizontal axis so as to move in a vertical plane coincident with the center line of said dummy pin and said panel pin guide groove between its upper position and a lower position, said lower position of said arm being out of the vertical path of movement of said mask.

3. Apparatus according to claim 2 wherein said control means for said dummy pins is effective to displace said dummy pins out of the path of movement of said mask means after disengagement from their corresponding panel-pin holes.

4. Apparatus according to claim 1 wherein said aligning stands are mounted for longitudinal movement parallel to the center line of the dummy pin thereon to increase and decrease distance between said opposing aligning stands.

5. Apparatus according to claim 4 including means to adjust said stands laterally relative to the center line of the dummy pin to enable registry of the dummy pins with the corresponding panel-pin holes, and registry of the guide groove with said panel pins.

6. Apparatus according to claim 1 wherein said panel support means includes panel centering rests having upstanding guide surfaces which converge inwardly toward a horizontal bottom supporting surface, said side surfaces positioning the panel so as to register said panel pins with the upper position of said guide grooves.

7. For use in manufacturing color picture tubes, apparatus for mounting an inverted cup-shaped shadow mask in a horizontal cup-shaped panel having at least three pins mounted on the interior periphery and directed horizontally inward within the panel, said mask having at least three spring pieces on its outer periphery, each piece having a panel-pin hole adapted to register with and receive a corresponding one of said panel pins to accurately mount said mask on said panel for removal and replacement;

means to support said inverted cup-shaped panel horizontally;

means for supporting said shadow mask below said panel;

a mask-centering mechanism for said mask to position said spring pieces substantially in vertical alignment with said corresponding pins respectively ;

an aligning stand for each spring piece, each stand having a rod arm with a panel-pin guide groove at the tip thereof, said rod arm being movable to and from an upper position in which said guide groove is horizontal to register with the corresponding panel pin of a panel supported on said support means, each stand also having a dummy pin with its center line parallel to and in the same vertical plane as the center line of the panel-pin guide groove in the upper position of said rod arm, control means to effect the advancement and withdrawal of said dummy pin into and out of the corresponding panel-pin hole of the mask positioned by said mask-centering mechanism;

opposing claw bodies which are able to advance and withdraw for clamping against the spring pieces having panel-pin holes, when said mask has been positioned with said dummy pins inserted into said panel-pin holes, said claw bodies having V-grooves at the tips thereof adapted to register with said panel-pin holes and with the dummy pin inserted thereinto, means to adjust said claw bodies into the right position for registering the V-grooves with corresponding dummy pins, clamp means operable to displace said claw bodies relative to said dummy pin and thereby clamp the spring pieces to disengage the dummy pins from their associated holes;

said rod arms being movable into said upper position to engage and receive panel pins in their panel-pin guide grooves for centering said inverted panel, whereby the panel pins of said panel are in vertical alignment with said panel-pin holes;

whereby said shadow mask is mounted on said panel by moving said mask vertically upward while said spring pieces are clamped until the panel pins are positioned in said V-grooves of said claw bodies, and then withdrawing said claw bodies, thereby inserting said panel pins into said panel-pin holes by the resilient force of said spring pieces.

8. Apparatus according to claim 7 wherein said rod arm is mounted for rotation about a horizontal axis for movement in a vertical plane such that the center line of the panel pin guide groove remains coplanar with the center line with the dummy pin in each aligning stand, the rod arm being rotatable from said upper position to a lower position out of the path of travel of the shadow mask in its vertically upward movement.

9. Apparatus according to claim 7 including means to guide said panel into position on said panel support means so that the inwardly directed pins thereof are in substantial registry with the guide grooves of said rod arms when displaced into their upper positions.

10. Apparatus according to claim 7 wherein said shadow mask supporting means is mounted for movement on a vertical axis by a center shaft, support posts and sliding guide posts.

11. In manufacturing color picture tubes, a method for mounting an inverted cup-shaped shadow mask in an inverted cup-shaped panel having at least three pins mounted on the interior periphery respectively directed horizontally inward within the panel, said mask having at least three spring pieces on its outer periphery, each piece having a panel-pin hole adapted to register with and receive a corresponding one of said panel pins to accurately mount said mask on said panel for removal and replacement;

providing a support for said cup-shaped panel inverted horizontally with its pins directed horizontally inward;

positioning said shadow mask below said panel support with said spring pieces in vertical alignment with said corresponding panel pin positions by providing an aligning stand for each spring piece, each stand having a rod arm with a panel-pin guide groove at the tip thereof, said rod arm being movable to and from an upper position in which said guide groove is horizontal to register with said corresponding panel pin, each stand also having a dummy pin engagable in the corresponding panel-pin hole of the mask, said dummy pin having its center line parallel to and in the same vertical plane as the center line of the panel-pin guide groove when said arm is in its upper position, and inserting said dummy pins into the corresponding panel-pin holes of the mask spring pieces;

providing opposing claw bodies for clamping against the spring pieces when said mask has been positioned, said claw bodies having V-grooves at the tips thereof;

adjusting said claw bodies by registering the V-grooves with the inserted dummy pins, displacing the spring pieces inwardly relative to said dummy pins, and disengaging the dummy pins from their corresponding panel-pin holes;

centering an inverted panel on said support relative to said mask by moving the rod arms to their upper positions and engaging the panel pins in the guide grooves and thereafter lowering said rod arms away from their upper positions and said corresponding panel pins;

moving said mask vertically relative to said panel while the spring pieces are clamped by said claw bodies until the panel pins are engaged in said V-grooves; and then withdrawing said claw bodies, thereby inserting said panel pins into said panel-pin holes by the resilient force of said spring pieces.

* * * * *